US010392819B2

(12) United States Patent
Hwang

(10) Patent No.: US 10,392,819 B2
(45) Date of Patent: Aug. 27, 2019

(54) GROUTING APPARATUS

(71) Applicants: YOOGU E&C Co., Ltd., Gyeonggi-do (KR); Woon Sik Hwang, Seoul (KR)

(72) Inventor: Woon Sik Hwang, Seoul (KR)

(73) Assignee: YOOGU E&C CO., LTD., Seoul (KR)

( * ) Notice: Subject to any disclaimer, the term of this patent is extended or adjusted under 35 U.S.C. 154(b) by 71 days.

(21) Appl. No.: 15/746,278

(22) PCT Filed: Jul. 13, 2016

(86) PCT No.: PCT/KR2016/007628
§ 371 (c)(1),
(2) Date: Oct. 3, 2018

(87) PCT Pub. No.: WO2017/014488
PCT Pub. Date: Jan. 26, 2017

(65) Prior Publication Data

US 2019/0078343 A1 Mar. 14, 2019

(30) Foreign Application Priority Data

Jul. 22, 2015 (KR) ..... 10-2015-0103580

(51) Int. Cl.
*E02D 3/12* (2006.01)
*E04G 23/02* (2006.01)
(Continued)

(52) U.S. Cl.
CPC ..... *E04G 23/0218* (2013.01); *E02D 3/046* (2013.01); *E02D 3/12* (2013.01); *E04G 23/0211* (2013.01); *E21D 9/001* (2013.01)

(58) Field of Classification Search
CPC ... E02D 3/12; E02D 2250/003; E21D 20/028; E21D 9/001; E21D 9/002; E04G 23/0211; E04G 23/0203
(Continued)

(56) References Cited

U.S. PATENT DOCUMENTS

2016/0237636 A1* 8/2016 Li ..... E02D 3/12

FOREIGN PATENT DOCUMENTS

JP 60261825 A * 12/1985 ..... E02D 3/12
JP 03271419 A * 12/1991
(Continued)

OTHER PUBLICATIONS

International Search Report of International App. No. PCT/KR2016/007628, dated Dec. 23, 2016, which is in the same family as U.S. Appl. No. 15/746,278, 5 pgs.
(Continued)

*Primary Examiner* — Frederick L Lagman
(74) *Attorney, Agent, or Firm* — Troutman Sanders LLP; Ryan A. Schneider

(57) ABSTRACT

The present invention relates to a grouting apparatus. In detail, the present invention provides a grouting apparatus which injects a reinforcing material into an object in which an injection hole into which the reinforcing material is injected is formed, the grouting apparatus including: a pumping unit which pumps the reinforcing material to be injected into the object; an injection pipe which has one side connected to the pumping unit, and the other side inserted into the injection hole, and injects the reinforcing material conveyed by the pumping unit into the object; a vibration generating unit which generates vibration; and a vibration wire which has one end coupled to the vibration generating unit, and the other end extending along the injection pipe and coupled to a tip of the injection pipe, and transmits the vibration generated by the vibration generating unit to the injection pipe.

6 Claims, 5 Drawing Sheets

(51) Int. Cl.
*E21D 9/00* (2006.01)
*E02D 3/046* (2006.01)

(58) Field of Classification Search
USPC ..... 405/269
See application file for complete search history.

(56) References Cited

FOREIGN PATENT DOCUMENTS

| | | | |
|---|---|---|---|
| JP | 2003013444 | A | 1/2003 |
| JP | 2004052393 | A | 2/2004 |
| JP | 2010168764 | A | 8/2010 |
| KR | 100989585 | B1 | 10/2010 |
| KR | 101371597 | B1 | 3/2014 |

OTHER PUBLICATIONS

Written Opinion of International App. No. PCT/KR2016/007628, dated Dec. 23, 2016, which is in the same family as U.S. Appl. No. 15/746,278, see p. 3 list of references cited, 4 pgs.

* cited by examiner

GROUTING APPARATUS

CROSS-REFERENCE TO RELATED APPLICATIONS

This application claims priority to PCT Application No. PCT/KR2016/007628 filed Jul. 13, 2016, which claims the benefit of KR Application No. 10-2015-0103580, filed Jul. 22, 2015, each of which is incorporated herein by reference in its entirety.

FIELD OF THE DISCLOSURE

The present invention relates to a grouting apparatus used to reinforce the ground and repair a crack in a structure by injecting a reinforcing material such as cement milk into the crack in the structure or the ground.

BACKGROUND OF THE DISCLOSURE

A grouting method is used to reinforce a weak part of a structure by injecting a reinforcing material such as cement milk, mortar, and suspension into the weak part.

The grouting method is very widely used, and the purposes of the grouting method may be broadly classified into two purposes. One purpose is to inject a reinforcing material into the ground. For example, in the case of a soft ground, a number of boreholes are formed at predetermined intervals, the reinforcing material is injected into the boreholes with pressure, and the reinforcing material injected into the boreholes penetrates into the surrounding ground through pores in the soil, such that the ground is stabilized. Therefore, the depth to which the reinforcing material penetrates into the ground surrounding the borehole is the most important factor in a ground reinforcing method using the grouting method.

Meanwhile, the other purpose of the grouting method is to repair a crack in a structure. If the crack is formed in the structure such as a building, a tunnel, and an underground public facility, the crack itself causes a risk to stability of the structure. Furthermore, in the case of an underground structure, groundwater and the like flows into the cracked gap, such that a severe danger may be caused in respect to stability of the structure. Therefore, the crack is filled with the reinforcing material such as suspension and cement liquid chemical grouting materials by injecting the reinforcing material into the cracked gap in the structure by using the grouting method. Whether the reinforcing material penetrates deep into the crack is the most important factor even in the method of reinforcing the structure.

However, the reinforcing material is rapidly cured or fluidity of the reinforcing material rapidly deteriorates in a case, in which the reinforcing material is injected only depending on pressure, and as a result, the reinforcing material does not penetrate deep into the ground or the injection is not smoothly performed because the gap in the object is clogged. If the injection of the reinforcing material is not smoothly performed, the reinforcing material injected into the borehole is not uniformly distributed or the reinforcing material cannot penetrate into the pores or fine cracks in the soil, and as a result, the structure cannot be sufficiently reinforced.

The inventors of the present invention have completed the present invention after lengthy studies in order to effectively solve the aforementioned problems.

As a related technology, there is Korean Patent No. 10-0869566 (registered on Nov. 28, 2008 and entitled 'Apparatus for Repairing Crack and Method of Repairing Crack using the same').

An objective of the present invention is to provide a grouting apparatus in which vibration wires, which include iron wires, steel wires, and various types of alloys and special fusion materials having high tensile force and capable of easily transmitting vibration, are tightly coupled, in a longitudinal direction, to injection pipes, which are configured to inject a reinforcing material and include various types of steel pipes, low-pressure or high-pressure hoses, and various types of injection pipes, and the injection pipe and the reinforcing material are directly vibrated when injecting the reinforcing material into a borehole, such that the reinforcing material may be smoothly and uniformly injected into the borehole in the ground, and the reinforcing material may penetrate deep into a fine gap with improved penetration force.

Another objective of the present invention is to provide a grouting apparatus in which a number of vibration wires are provided to be coupled to a single vibration generating unit, such that the reinforcing material may be uniformly injected into a number of boreholes by generating vibration by using the single vibration generating unit.

BRIEF DESCRIPTION OF THE EXEMPLARY EMBODIMENTS

To achieve the aforementioned objectives, an exemplary embodiment of the present invention provides a grouting apparatus which injects a reinforcing material into an object in which an injection hole into which the reinforcing material is injected is formed, the grouting apparatus including: a pumping unit which pumps the reinforcing material to be injected into the object; an injection pipe which has one side connected to the pumping unit, and the other side inserted into the injection hole, and injects the reinforcing material conveyed by the pumping unit into the object; a vibration generating unit which generates vibration; and a vibration wire which has one end coupled to the vibration generating unit, and the other end extending along the injection pipe and coupled to a tip of the injection pipe, and transmits the vibration generated by the vibration generating unit to the injection pipe.

The vibration wire is tightly attached to the injection pipe in a longitudinal direction of the injection pipe.

The present invention may further include a band which surrounds circumferences of the vibration wire and the injection pipe so that the vibration wire and the injection pipe are tightly attached to each other.

A number of bands may be installed in the longitudinal direction of the injection pipe.

The vibration wire is spirally wound around the injection pipe.

The vibration generating unit is connected to a part of the injection pipe which is exposed to the outside of the injection hole, and may transmit the vibration to the injection pipe.

A number of injection pipes may be more than one so that the reinforcing material is injected into a number of injection holes formed in the object, and a number of vibration wires may be more than one so that the vibration generated by the vibration generating unit is transmitted to a number of injection pipes.

In this case, the vibration generating unit may include: a main unit which generates vibration; and a vibration transmission plate which is coupled to the main unit to transmit the vibration generated by the main unit to the vibration wires, and formed in the form of a plate so that all of a number of vibration wires are disposed thereon.

Another exemplary embodiment of the present invention provides a grouting apparatus which injects a reinforcing material into an object in which an injection hole into which the reinforcing material is injected is formed, the grouting apparatus including: a pumping unit which pumps the reinforcing material to be injected into the object; an injection pipe which has one side connected to the pumping unit, and the other side inserted into the injection hole, and injects the reinforcing material conveyed by the pumping unit into the object; a vibration generating unit which generates vibration; a packer which is mounted at a tip of the injection pipe, and seals a portion between the injection pipe and an inner wall of the injection hole; and a vibration wire which has one end coupled to the vibration generating unit, and the other end extending along the injection pipe and coupled to the tip of the injection pipe or the packer, and transmits the vibration generated by the vibration generating unit to the injection pipe.

The vibration wire is tightly attached to the injection pipe in the longitudinal direction of the injection pipe. The number of injection pipes may be more than one so that the reinforcing material is injected into a number of injection holes formed in the object, and a number of vibration wires may be more than one so that the vibration generated by the vibration generating unit is transmitted to a number of injection pipes.

According to the grouting apparatus in the present invention, the vibration wire is directly and tightly coupled to the injection pipe, and vibration generated by the vibration generating unit is transmitted to the injection pipe to vibrate the injection pipe when injecting the reinforcing material into the gap in the structure or the ground, thereby smoothly and uniformly injecting the reinforcing material into the borehole in the ground, and allowing the reinforcing material to penetrate deep into the fine gap in the structure.

In addition, the vibration generating unit and the injection pipe are tightly coupled to each other, such that vibration of the vibration generating unit may be transmitted directly to the injection pipe.

Moreover, a number of vibration wires are provided to be coupled to the single vibration generating unit, such that the reinforcing material may be uniformly injected into a number of boreholes or a number of gaps by generating vibration by using the single vibration generating unit.

Meanwhile, it is added that effects described in the following specification and provisional effects thereof, which are expected by the technical features of the present invention, are considered as the effects described in the specification of the present invention even though these effects are not clearly mentioned herein.

Figure 1:
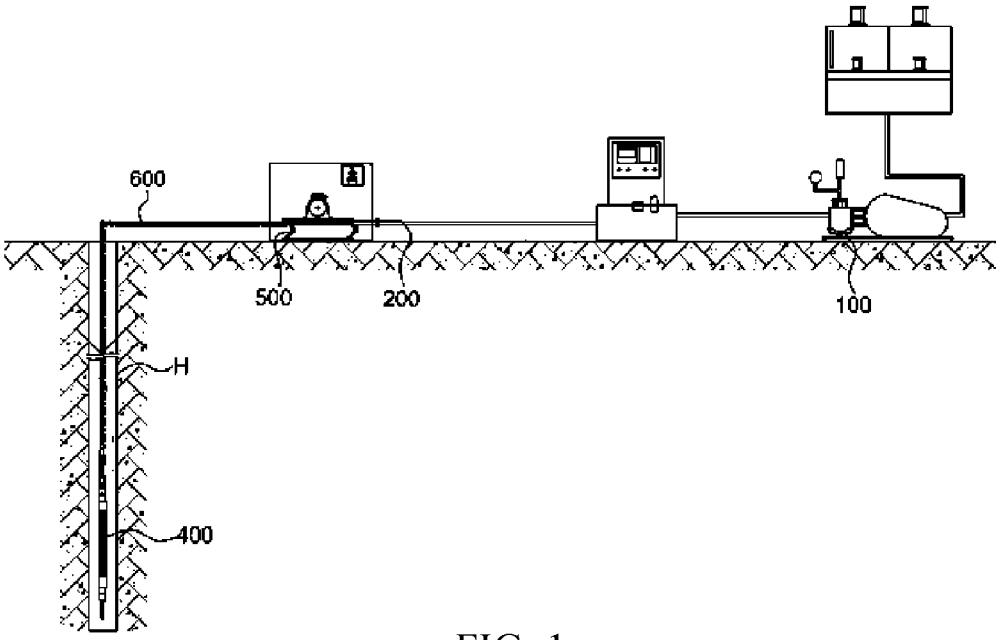
FIG. 1 is a view illustrating a state in which a grouting apparatus according to the exemplary embodiment of the present invention is installed on the ground surface.

The accompanying drawings are illustratively provided to assist in understanding the technical idea of the present invention, and the scope of the present invention is not limited by the accompanying drawings.

DETAILED DESCRIPTION

The present invention may have various modifications and a variety of exemplary embodiments, and thus specific exemplary embodiments will be illustrated in the drawings and described in detail in the detailed description. However, the description is not intended to limit the present invention to the specific exemplary embodiments, and it is to be understood that all the changes, equivalents, and substitutions belonging to the idea and technical scope of the present invention are included in the present invention. In the description of the present invention, the specific descriptions of publicly known related technologies will be omitted when it is determined that the specific descriptions may obscure the subject matter of the present invention.

Terms used in the present application are used only to describe specific exemplary embodiments, and are not intended to limit the present invention. Singular expressions used herein include plurals expressions unless they have definitely opposite meanings in the context. In the present application, it should be appreciated that terms "including" and "having" are intended to designate the existence of characteristics, numbers, steps, operations, constituent elements, and components described in the specification or a combination thereof, and do not exclude a possibility of the existence or addition of one or more other characteristics, numbers, steps, operations, constituent elements, and components, or a combination thereof in advance.

Hereinafter, a grouting apparatus according to the present invention will be described in detail with reference to the accompanying drawings, and in the description of the grouting apparatus, the same or corresponding constituent elements will be designated by the same reference numerals, and a duplicated description thereof will be omitted.

The present invention relates to a grouting apparatus which forms an injection hole in an object such as a structure or the ground by using a drill, inserts an injection pipe into the injection hole, and injects a reinforcing material into the injection hole, thereby reinforcing the object.

The reinforcing material is injected into the injection hole in the object by using injection pressure, and as described above, the injection may not be smoothly performed because the reinforcing material is cured or fluidity of the reinforcing material deteriorates. In addition, cracks such as joints and gaps are clogged as the reinforcing material is adsorbed to a surface of the object, and as a result, the reinforcing material cannot penetrate into the fine gaps in the injection hole.

Therefore, the present invention provides the grouting apparatus which vibrates the injection pipe when injecting the reinforcing material through the injection pipe, such that the reinforcing material may be smoothly sprayed from a tip of the injection pipe, the reinforcing material may be uniformly distributed in the injection hole, and the reinforcing material may penetrate into fine gaps such as pores in the soil and joints in bedrock by increasing fluidity and penetration force of the reinforcing material by using vibration.

In the present invention, various types of objects such as the ground formed of soil, bedrock, or building/civil engineering structures may be applied as the object into which the reinforcing material is injected.

However, the grouting is mainly used to reinforce a soft ground and fill a crack in a structure, and these two cases will thus be described as examples in the following exemplary embodiments.

FIG. 1 is a view for explaining an example in which a ground reinforcing method using a grouting apparatus according to an exemplary embodiment of the present invention is used. The grouting apparatus according to the present invention will be described with reference to FIGS. 1 to 7 on the assumption that the object into which the reinforcing material is injected is the 'ground'.

The grouting apparatus according to the present invention includes a pumping unit 100, an injection pipe 200, a vibration generating unit 500, and a vibration wire 600.

First, the injection pipe 200 is a hollow pipe for injecting a reinforcing material into the ground, and various types of injection pipes such as various types of steel pipes, high-pressure hoses, Manchette tubes, and flexible pipes may be used. An upper portion of the injection pipe 200 communicates with the pumping unit 100, and the remaining portion of the injection pipe 200 is inserted into an injection hole H. The pumping unit 100 to be described below is installed outside the injection hole H, that is, on the ground, and as a result, the upper portion of the injection pipe 200, which communicates with the pumping unit 100, is inevitably exposed to the ground. In the present invention, the configuration in which the upper portion of the injection pipe 200 is exposed to the ground is not a simple matter of arrangement, but has very important meanings in terms of providing vibration, and this configuration will be described below.

The pumping unit 100 pumps the reinforcing material under preset pressure in order to convey the reinforcing material to the injection hole H through the injection pipe 200. The reinforcing material pumped by the pumping unit 100 is injected into the injection hole H along the injection pipe 200, and in the present exemplary embodiment, a flowmeter (not illustrated) is installed at an outlet of the pumping unit 100 or in the injection pipe 200, such that a flow rate of the reinforcing material moving along the injection pipe 200 may be checked in real time.

The vibration generating unit 500 is installed outside the injection hole H, that is, on the ground to generate vibration, and a motor is mainly used as the vibration generating unit 500. In addition, vibration of the motor may be generated in up, down, left, and right directions and vibration may be provided regularly or irregularly by using an eccentric cam or various mechanical combinations. In addition, intensity or frequency of vibration may be variously changed by adjusting an output of the motor. That is, the vibration generating unit may generate vibration having various types of intensity and directions in accordance with the type of reinforcing material or the type of object into which the reinforcing material is injected. The vibration generated by the vibration generating unit 500 is applied to the vibration wire 600 to be described below, and then transmitted to the reinforcing material.

One end of the vibration wire 600 is coupled to the vibration generating unit 500, and the other end of the vibration wire 600 extends in a longitudinal direction of the injection pipe 200 and is coupled to a tip of the injection pipe 200 or a packer 400 to be described below. Therefore, the vibration wire 600 serves to transmit the vibration generated by the vibration generating unit 500 to the injection pipe 200.

For example, various types of alloys and special fusion materials such as iron wires and steel wires, which have excellent vibration transmission properties and high tensile force, may be used as the vibration wire 600.

In the present invention, the vibration wire and the injection pipe 200 are tightly attached to each other in order to effectively transmit the vibration generated by the vibration generating unit 500 to the reinforcing material. That is, the vibration wire 600 is disposed in the longitudinal direction of the injection pipe 200 and tightly attached to the injection pipe 200. Therefore, the vibration generated by the vibration generating unit 500 is continuously applied in the longitudinal direction of the injection pipe 200, the injection pipe 200 tightly attached to the vibration wire 600 constantly receives the vibration, and the vibration is transmitted to the reinforcing material moving in the injection pipe 200, such that fluidity of the reinforcing material is improved. A vibration generator in a grouting apparatus in the related art is disposed inside a pumping unit to apply vibration directly to the reinforcing material, but it has been confirmed that in the present invention, the configuration in which vibration is applied to the entire injection pipe through the vibration wire is more effective in vibrating the reinforcing material than the configuration in the related technique. In particular, the present invention has an advantage in that since the vibration wire is tightly attached to the entire injection pipe in the longitudinal direction, it is possible to transmit vibration to the reinforcing material while minimizing a loss of vibration generated by the vibration generating unit. As a result, the present invention provides the structure in which the vibration of the vibration generating unit is transmitted to the reinforcing material through the vibration wire and the injection pipe, and as a result, a coupling structure between the vibration wire and the injection pipe is very important technically. The configuration will be described specifically with reference to the drawings.

Figure 2:
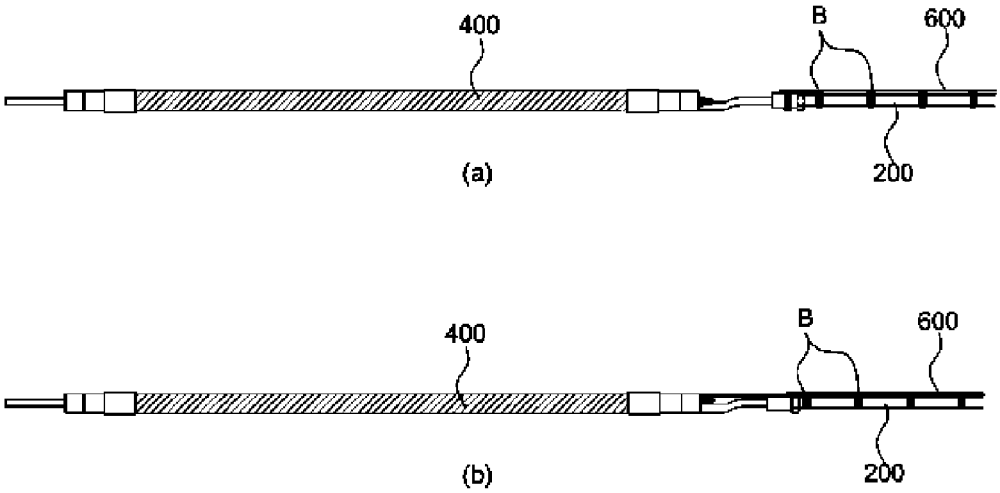
FIG. 2 is a view illustrating a coupling relationship between a vibration wire and an injection pipe of the grouting apparatus according to the exemplary embodiment of the present invention.

FIG. 2 is a view illustrating a coupling relationship between the vibration wire 600 and the injection pipe 200 of the grouting apparatus according to the exemplary embodiment of the present invention.

Referring to FIG. 2, the vibration wire 600 according to the present invention extends in parallel with the injection pipe 200 and is tightly attached to the injection pipe 200. In this case, an end portion of the vibration wire 600 may be coupled to the tip of the injection pipe 200 or the packer 400.

In this case, a number of bands B may surround circumferences of the vibration wire 600 and the injection pipe 200 so that the injection pipe 200 and the vibration wire 600 are tightly attached to each other. That is, the vibration wire 600 is disposed in parallel with the injection pipe 200, and a number of bands B are formed to be spaced apart from each other at predetermined intervals around the circumferences of the injection pipe 200 and the vibration wire 600. The injection pipe 200 and the vibration wire 600 are tightly attached to each other by the bands B. As a result, the vibration wire 600 and the injection pipe 200 may integrally react to the vibration generated by the vibration generating unit 500. Therefore, the vibration may be more effectively transmitted to the injection pipe 200 through the vibration wire 600.

Figure 3:
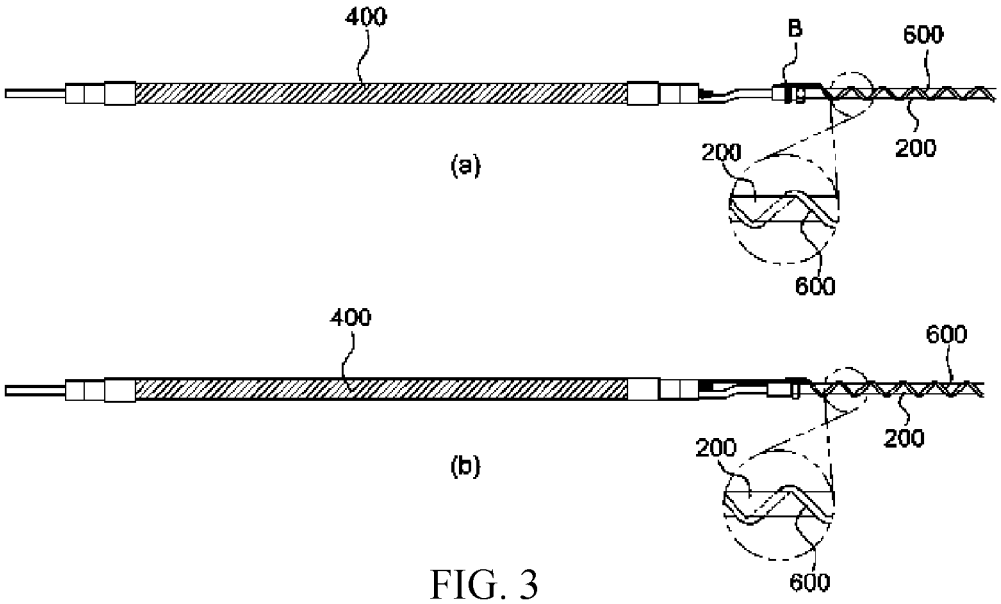
FIG. 3 is a view illustrating a coupling relationship between a vibration wire and an injection pipe of a grouting apparatus according to another exemplary embodiment of the present invention.
Figure 4:
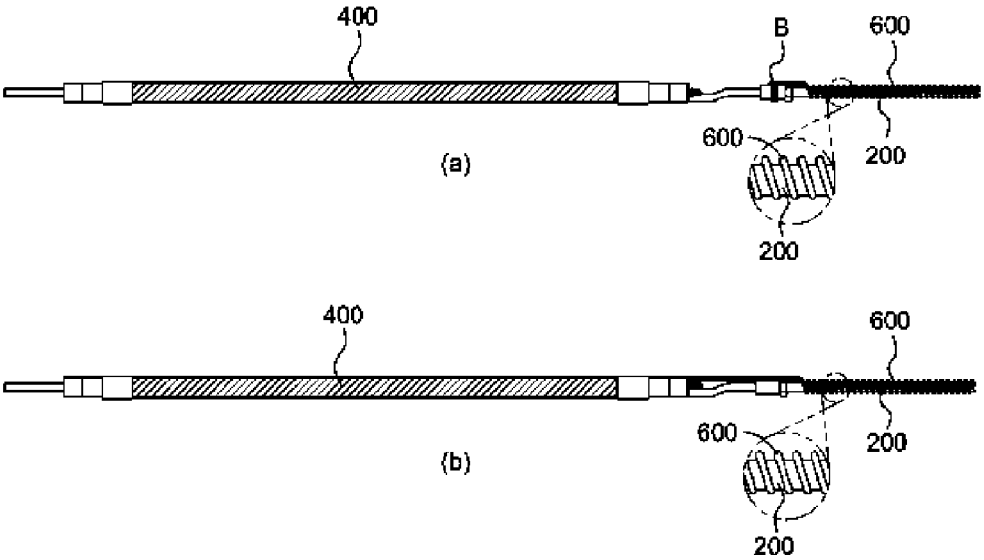
FIG. 4 is a view illustrating a coupling relationship between a vibration wire and an injection pipe of a grouting apparatus according to still another exemplary embodiment of the present invention.

FIG. 3 is a view illustrating a coupling relationship between a vibration wire 600 and an injection pipe 200 of a grouting apparatus according to another exemplary embodiment of the present invention, and FIG. 4 is a view illustrating a coupling relationship between a vibration wire 600 and an injection pipe 200 of a grouting apparatus according to still another exemplary embodiment of the present invention.

Referring to FIGS. 3 and 4, the configuration in which the vibration wire 600 is tightly attached to the injection pipe 200 in the longitudinal direction is identical to the configuration described above. However, examples illustrated in FIGS. 3 and 4 are characterized in that the vibration wire 600 is spirally wound around the injection pipe 200. That is, the vibration wire 600 may be spirally wound around the injection pipe 200 at a wider interval as illustrated in FIG. 3, or the vibration wire 600 may be spirally and densely wound around the injection pipe 200 at a narrower interval as illustrated in FIG. 4. In both of these two cases, the vibration wire 600 is more closely and tightly attached to the injection pipe 200, and the vibration wire 600 and the injection pipe 200 may integrate. The vibration wire and the injection pipe are disposed in parallel with each other in the aforementioned exemplary embodiment, but in the present exemplary embodiment, the vibration wire is spirally wound around the injection pipe, such that there is an advantage in that a region to which vibration is applied is further increased. Therefore, the vibration, which is generated by the vibration generating unit 500 and transmitted to the vibration wire 600, may be more effectively and directly transmitted to the injection pipe 200. It is obvious that the spiral interval of the vibration wire 600 may be adjusted to be narrow or wide as necessary.

As described above, in the present invention, the vibration of the vibration generating unit is applied to the vibration wire, and the vibration wire has a straight shape or a spiral shape and is tightly attached to the entire injection pipe, and as a result, it is possible to effectively vibrate the reinforcing material. Therefore, fluidity of the reinforcing material sprayed from the tip of the injection pipe 200 is greatly increased, and the reinforcing material may penetrate deep into the ground surrounding the injection hole.

A ground reinforcing method illustrated in FIG. 1 will be described as an example.

In general, in the ground surrounding the borehole, the soil is mainly placed to a predetermined depth and pores are formed between soil particles. A soft ground refers to a ground in which porosity between the soil particles is high and strength of the soil is thus low. Therefore, in the ground reinforcing method, injection holes are formed first in the form of a matrix in the soft ground at predetermined intervals. Furthermore, the reinforcing material is pressurized and injected into the injection holes by using the grouting apparatus so that the reinforcing material penetrates into the surrounding ground. To allow the reinforcing material to penetrate into the ground by providing pressure, a space into which the reinforcing material is injected needs to be sealed. To this end, a grout injecting apparatus according to the present exemplary embodiment is provided with the packer 400.

The packer 400 is mounted at the tip of the injection pipe 200, and seals a portion between the tip of the injection pipe 200 and an inner wall of the injection hole H. The packer may have various shapes, but in general, the packer is made of an elastically expandable rubber material, such that the packer is expanded and tightly attached to the inner wall of the injection hole when a fluid is injected into the packer, and the packer is shrunk when the fluid is discharged. Because the packer is a publicly known configuration, a more detailed description thereof will be omitted.

When the packer is expanded and tightly attached to the inner wall of the injection hole, a space from a lower end portion of the packer to a bottom surface of the injection hole is sealed. Further, the injection pipe penetrates the interior of the packer and extends to a foremost end of the grouting apparatus. When the reinforcing material is injected through the injection pipe in a state in which the space below the packer is sealed, the reinforcing material fills the injection hole first and then penetrates into the ground along pores in a soil layer surrounding the injection hole as pressure is continuously applied. After the reinforcing material is injected into a lowermost end portion of the injection hole as described above, the packer is shrunk, the grouting apparatus is retracted upward by a predetermined height, the packer is expanded again, and then the same process is performed. That is, the ground reinforcement is performed by separately pouring the reinforcing material for each section.

The grout injecting apparatus according to the present invention more effectively provides vibration to the reinforcing material that penetrates into the pores, thereby improving fluidity and penetration properties of the reinforcing material. In the case in which the vibration is applied to the entire injection pipe by using the vibration wire in accordance with the present invention, an effect of vibrating the reinforcing material is higher, and as a result, the ground reinforcement may be more smoothly performed in comparison with the related art in which vibration is applied directly to the reinforcing material.

The configuration and the function of the grout injecting apparatus according to the present invention have been described above in respect to the single injection hole, but the grout injecting apparatus according to the present invention may be applied to simultaneously perform the ground reinforcement on a number of injection holes.

Figure 5:
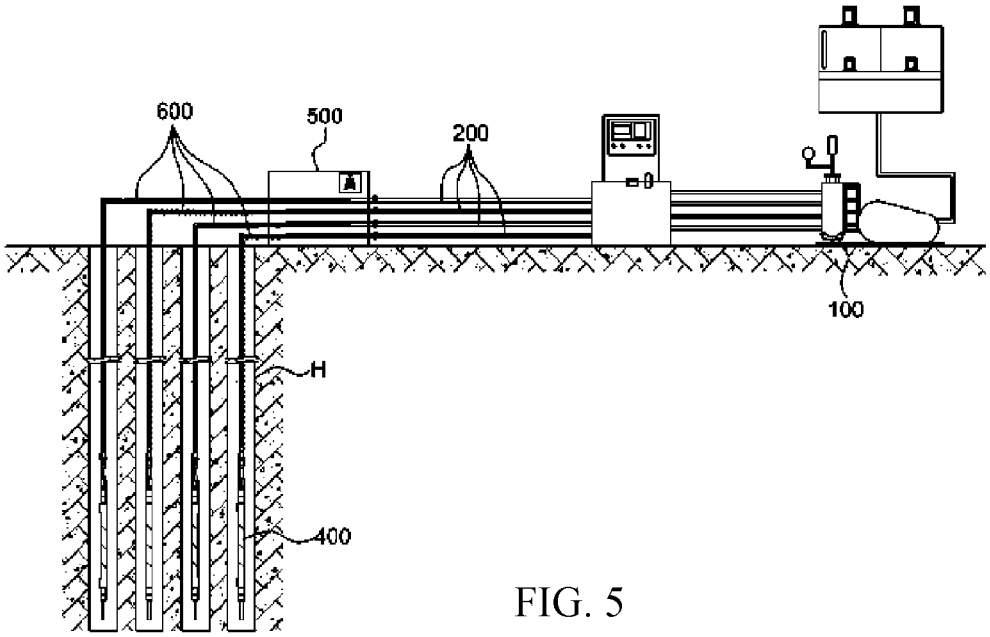
FIG. 5 is a view illustrating a state in which a grouting apparatus having a number of injection pipes and a number of vibration wires according to yet another exemplary embodiment of the present invention is installed on the ground surface.

FIG. 5 is a view illustrating a state in which a grouting apparatus having a number of injection pipes 200 and a number of vibration wires 600 according to yet another exemplary embodiment of the present invention is installed on the ground surface. Referring to FIG. 5, in the grouting apparatus according to the present invention, a number of injection pipes 200 are provided to inject the reinforcing material into a number of injection holes H formed in the ground, and the number of vibration wires 600 may correspond to the number of injection pipes 200.

In this case, a number of injection pipes 200 are coupled to the pumping unit 100 and inject the reinforcing material from the pumping unit 100 into the respective injection holes H, and a number of vibration wires 600 are coupled to the vibration generating unit 500 and transmit vibration from the vibration generating unit to the respective injection pipes 200. That is, the reinforcing material supplied from the single pumping unit 100 is injected into the respective injection holes H along the respective injection pipes 200, and the vibration generated by the single vibration generating unit 500 is transmitted to the respective injection pipes 200.

That is, the single pumping unit 100 and the single vibration generating unit 500 are installed, a number of injection pipes 200 are connected to the pumping unit, and a number of vibration wires 600 are correspondingly connected to the vibration generating unit, such that a number of injection holes H may be effectively filled with the reinforcing material. In the ground reinforcing method, a number of injection holes are formed, and as a result, there is an advantage in that construction time may be decreased when the process is performed on a number of injection holes at one time like the present exemplary embodiment. In addition, in general, a number of joints are formed in bedrock or a number of cracks are formed on a structure. In this case, the present invention may be optimized.

In this case, the vibration wires 600 are detachably coupled to the vibration generating unit 500, and the necessary number of vibration wires 600, that is, the number of vibration wires 600 corresponding to the number of injection holes may be coupled and used. In addition, a number of injection holes may be appropriately reinforced by the vibration generated by the single vibration generating unit, and as a result, time may be saved and economic feasibility of the process may be greatly improved.

The vibration generating unit 500 according to the present exemplary embodiment may include a main unit and a vibration transmission plate in order to perform simultaneously the process on a number of injection holes. That is, the main unit is a part for generating vibration, and the vibration transmission plate serves to transmit the vibration generated by the main unit to the vibration wires 600.

The vibration transmission plate may be formed in the form of a quadrangular plate, and in this case, the vibration wires 600 may be disposed on an upper portion of the vibration transmission plate so as to be spaced apart from one another at predetermined intervals. That is, when the vibration generated by the main unit is transmitted to the vibration transmission plate, the vibration is transmitted to a number of vibration wires 600 which are disposed on the upper portion of the vibration transmission plate so as to be spaced apart from one another at the predetermined intervals. Therefore, the vibration generated by the single vibration generating unit may be more easily transmitted to a number of vibration wires 600.

Figure 6:
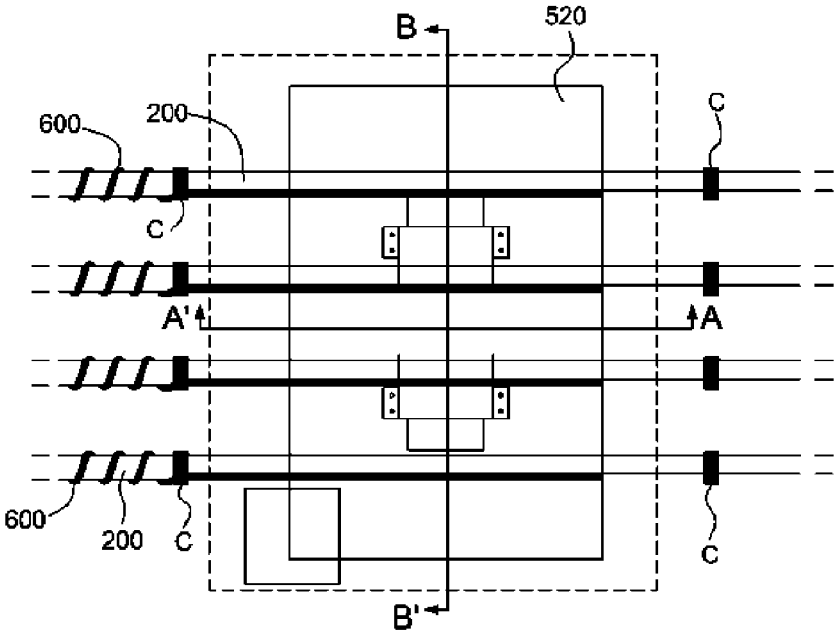
FIG. 6 is a view illustrating a number of vibration wires and injection pipes disposed on a vibration generating unit according to still yet another exemplary embodiment of the present invention.
Figure 7:
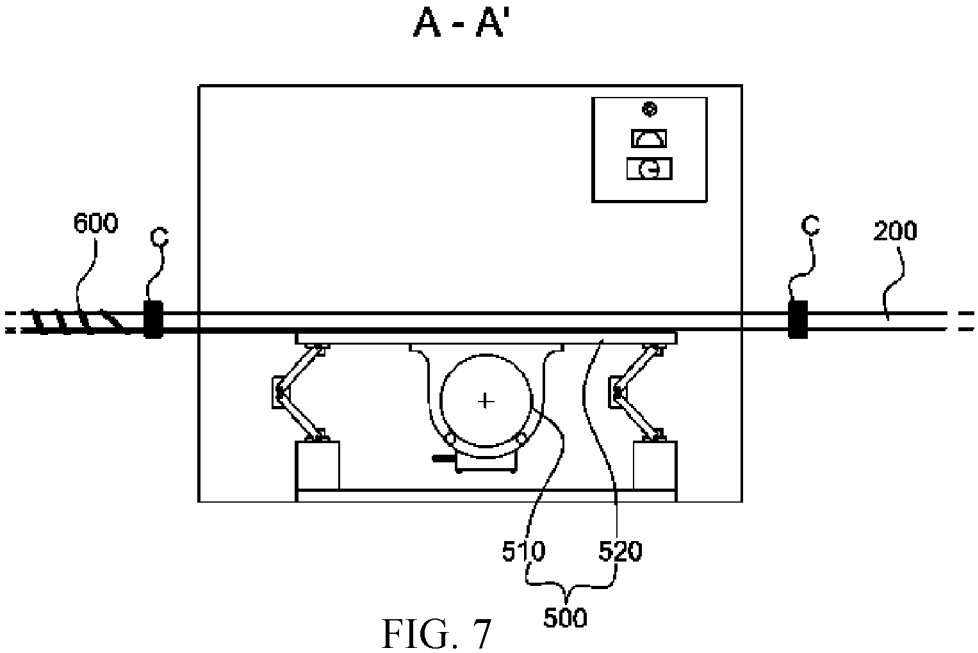
FIG. 7 is a cross-sectional view taken along line A-A' of FIG. 6.
Figure 8:
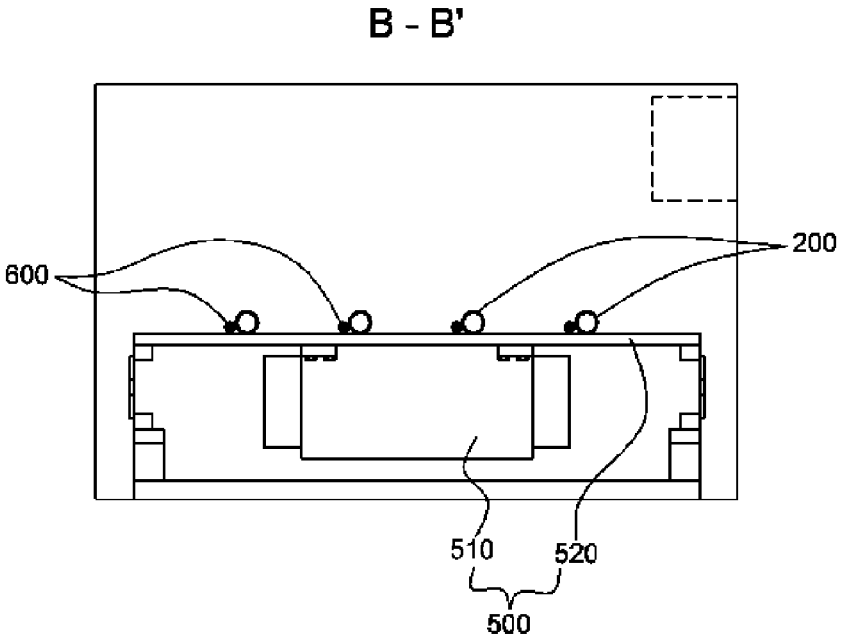
FIG. 8 is a cross-sectional view taken along line B-B' of FIG. 6.

FIG. 6 is a view illustrating a number of vibration wires 600 and injection pipes 200 disposed on a vibration generating unit 500 according to still yet another exemplary embodiment of the present invention, FIG. 7 is a cross-sectional view taken along line A-A' of FIG. 6, and FIG. 8 is a cross-sectional view taken along line B-B' of FIG. 6.

Referring to FIGS. 6 to 8, the vibration wires 600 are disposed on the upper portion of the vibration generating unit 500, such that the vibration generated by the vibration generating unit 500 is transmitted to the vibration wires 600 disposed on the upper portion of the vibration generating unit 500. In this case, a part of the injection pipe 200, which is exposed to the outside of the injection hole H, may be coupled to the upper portion of the vibration generating unit 500. That is, the injection pipes 200 are coupled directly to the vibration generating unit 500, such that the vibration generated by the vibration generating unit 500 may be transmitted directly to the injection pipes 200.

Therefore, according to the exemplary embodiment of the present invention, the injection pipes 200 are coupled directly to the vibration generating unit 500, such that the vibration of the vibration generating unit 500 may be transmitted directly to the injection pipes 200, the vibration may be transmitted to the vibration wires separately coupled to the vibration generating unit 500, and the vibration may be transmitted to the injection pipes 200. Therefore, efficiency in transmitting the vibration generated by the vibration generating unit 500 may be further increased.

In this case, a portion of the injection pipe 200, which is coupled directly to the vibration generating unit 500, and the remaining portion of the injection pipe 200 may be coupled to each other by a coupler C. The portion of the injection pipe, which is directly attached to the vibration generating unit 500 and receives vibration, is easily abraded or damaged, and the portion of the injection pipe may thus need to be replaced. Therefore, in this case, only the portion of the injection pipe 200, which is directly attached to the vibration generating unit 500, may be easily replaced.

Figure 9:
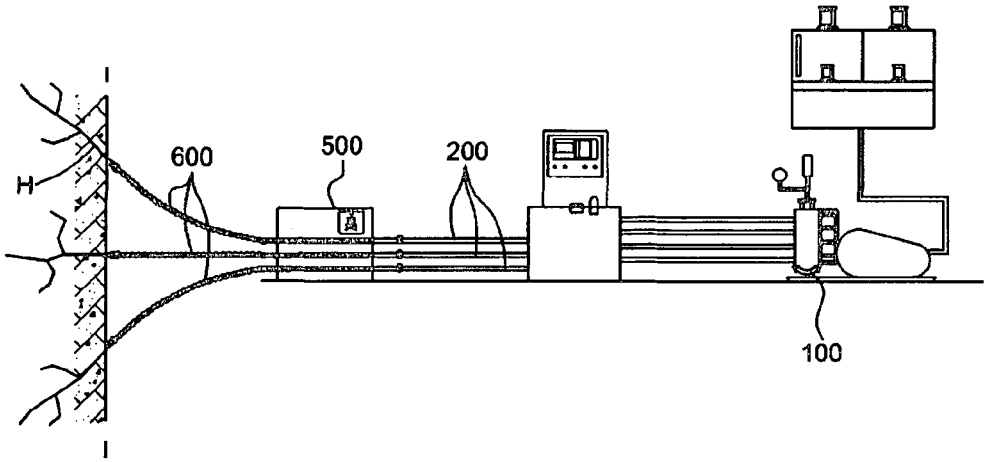
FIG. 9 is a view illustrating a state in which a reinforcing material is injected into a number of cracks formed in an object by using the grouting apparatus according to the exemplary embodiment of the present invention.

FIG. 9 is a view illustrating a state in which a reinforcing material is injected into a number of cracks formed in an object by using the grouting apparatus according to still yet another exemplary embodiment of the present invention. The aforementioned FIGS. 1 and 5 illustrate an example in which the grout injecting apparatus according to the present invention is used for the ground reinforcing method, but FIG. 9 illustrates a case in which the grout injecting apparatus is used to repair a crack in a structure. The case in which the grout injecting apparatus according to the present invention is used to reinforce a joint in bedrock or repair a crack in a structure as illustrated in FIG. 9 is identical to the case in which the grout injecting apparatus is used for the ground reinforcing method as illustrated in FIG. 1 in terms of mechanical configurations of the grout injecting apparatus. However, there is a difference only in that a packer is not mounted at a tip of an injection pipe in the case in which the grout injecting apparatus is used to repair a crack as illustrated in FIG. 9. That is, as described above, one side of the injection pipe is coupled to the pumping unit for supplying the reinforcing material, and the other side of the injection pipe is connected to an inlet of a crack, such that the reinforcing material from the pumping unit may be injected into the crack in the structure. In particular, an insertion member such as a socket into which the injection pipe and the vibration wire may be inserted together is mounted in the inlet of the crack, such that the injection pipe and the vibration wire may be stably coupled to the object.

As illustrated in FIG. 9, a number of cracks may be present in an object, and the reinforcing material may be simultaneously injected into a number of cracks by using the grouting apparatus according to the present invention, and as a result, time may be saved and economic feasibility may be greatly improved. In this case, the reinforcing material may be injected directly into the crack in the object without inserting the injection pipe, or the reinforcing material may be injected after the injection hole is formed by using the drill and then the injection pipe is inserted into the injection hole. That is, the injection pipe 200 may be inserted into the crack in accordance with a size of the crack or a situation of the crack, or the injection pipe 200 may be connected to the inlet of the crack from the outside of the crack.

In a case in which the reinforcing material is injected into the crack in the object, the injection of the reinforcing material may not be smoothly performed due to various conditions such as curing of the reinforcing material, a size of the crack, and a depth of the crack as well as fluidity of the reinforcing material. Therefore, according to the present invention, the reinforcing material is uniformly injected into the crack by improving fluidity of the reinforcing material by vibrating the reinforcing material when injecting the reinforcing material and it is possible to delay the curing of the reinforcing material, thereby injecting the reinforcing material deep into the fine crack.

In addition, even in the case in which a number of cracks are formed in an object, the vibration generated by the single vibration generating unit 500 is transmitted to the injection pipes which are connected to the respective cracks and inject the reinforcing material, and as a result, it is possible to simultaneously and efficiently repair a number of cracks in the object.

That is, with the use of a number of injection pipes 200 and a number of vibration wires 600 tightly attached to the injection pipes 200 of the grouting apparatus according to the present invention, the vibration generated by the single vibration generating unit 500 is transmitted to a number of injection pipes through a number of vibration wires 600, and the reinforcing material, which is injected into the respective cracks, is vibrated. Therefore, it is possible to simultaneously and efficiently inject the reinforcing material into a number of cracks formed in the object by using the single vibration generating unit 500.

In addition, it is possible to allow the reinforcing material to efficiently penetrate deep into the fine crack in the injection hole H by delaying the curing of the reinforcing material inserted into the gap. In this case, the cracks include various types of gaps such as cracks in the injection holes in the ground, joints in bedrock, and pores in the soil.

The protection scope of the present invention is not limited to the disclosure and expressions of the exemplary embodiment clearly described above. In addition, it is added that the protection scope of the present invention is not limited by modifications and substitutions obvious to the technical field to which the present invention pertains.

The invention claimed is:

1. A grouting apparatus which injects a reinforcing material into an object in which an injection hole into which the reinforcing material is injected is formed, the grouting apparatus comprising:

a pumping unit which pumps the reinforcing material to be injected into the object;

an injection pipe which has one side connected to the pumping unit, and the other side inserted into the injection hole, and injects the reinforcing material conveyed by the pumping unit into the object;

a vibration generating unit which generates vibration; and a vibration wire which has one end coupled to the vibration generating unit, and the other end extending along the injection pipe and coupled to a tip of the injection pipe, and transmits the vibration generated by the vibration generating unit to the injection pipe, wherein the vibration wire is spirally wound around the injection pipe so as to be tightly attached to an outer portion of the injection pipe in a longitudinal direction of the injection pipe.

2. The grouting apparatus of claim 1, wherein the number of injection pipes is more than one so that the reinforcing material is injected into a number of injection holes formed in the object, and the number of vibration wires is more than one so that the vibration generated by the vibration generating unit is transmitted to a number of injection pipes.

3. The grouting apparatus of claim 2, wherein the vibration generating unit includes:

a main unit which generates vibration; and a vibration transmission plate which is coupled to the main unit to transmit the vibration generated by the main unit to the vibration wires, and formed in the form of a plate so that all of a number of vibration wires are disposed thereon.

4. A grouting apparatus which injects a reinforcing material into an object in which an injection hole into which the reinforcing material is injected is formed, the grouting apparatus comprising:

a pumping unit which pumps the reinforcing material to be injected into the object;

an injection pipe which has one side connected to the pumping unit, and the other side inserted into the injection hole, and injects the reinforcing material conveyed by the pumping unit into the object;

a vibration generating unit which generates vibration;

a packer which is mounted at a tip of the injection pipe, and seals a portion between the injection pipe and an inner wall of the injection hole; and a vibration wire which has one end coupled to the vibration generating unit, and the other end extending along the injection pipe and coupled to the tip of the injection pipe or the packer, and transmits the vibration generated by the vibration generating unit to the injection pipe, wherein the vibration wire is spirally wound around the injection pipe so as to be tightly attached to an outer portion of the injection pipe in a longitudinal direction of the injection pipe.

5. The grouting apparatus of claim 4, wherein the number of injection pipes is more than one so that the reinforcing material is injected into a number of injection holes formed in the object, and the number of vibration wires is more than one so that the vibration generated by the vibration generating unit is transmitted to a number of injection pipes.

6. A grouting apparatus which injects a reinforcing material into an object in which a crack into which the reinforcing material is injected is formed, the grouting apparatus comprising:

a pumping unit which pumps the reinforcing material to be injected into the object;

an injection pipe which has one side connected to the pumping unit, and the other side connected to an inlet of the crack, and injects the reinforcing material conveyed by the pumping unit into the crack;

a vibration generating unit which generates vibration; and a vibration wire which has one end coupled to the vibration generating unit, and the other end extending along the injection pipe and coupled to a tip of the injection pipe, and transmits the vibration generated by the vibration generating unit to the injection pipe, wherein the vibration wire is spirally wound around the injection pipe so as to be tightly attached to an outer portion of the injection pipe in a longitudinal direction of the injection pipe.

* * * * *